US006877426B1

(12) United States Patent
Huang

(10) Patent No.: US 6,877,426 B1
(45) Date of Patent: Apr. 12, 2005

(54) STAMPING DEVICE HAVING A REVERSIBLE PRINTING MEMBER

(76) Inventor: Chien-Kai Huang, No. 136, Tsu Chiang Road, Chang Hua City (TW)

( * ) Notice: Subject to any disclaimer, the term of this patent is extended or adjusted under 35 U.S.C. 154(b) by 0 days.

(21) Appl. No.: 10/795,221

(22) Filed: Mar. 9, 2004

(51) Int. Cl.[7] ..... B41K 1/42
(52) U.S. Cl. ..... 101/334; 101/104
(58) Field of Search ..... 101/334, 327, 101/405–406, 103–106, 108, 111

(56) References Cited

U.S. PATENT DOCUMENTS 3,714,894 A * 2/1973 Robinson ..... 101/389.1
3,866,021 A * 2/1975 Kessler ..... 377/87
3,880,079 A * 4/1975 Klapholz ..... 101/334
5,152,223 A * 10/1992 Mairon ..... 101/334
5,359,932 A * 11/1994 Van Breene ..... 101/334
5,623,875 A * 4/1997 Perets ..... 101/334
5,740,737 A * 4/1998 Polak et al. ..... 101/334
5,743,186 A * 4/1998 Liao ..... 101/334

* cited by examiner

*Primary Examiner*—Eugene H. Eickholt
(74) *Attorney, Agent, or Firm*—Bacon & Thomas PLLC

(57) ABSTRACT

A stamping device includes a printing member which has two pivot shafts pivotably connected to two insides of a casing and a plurality of teeth are arranged along a semi-circular protrusion on two ends of the printing member. The two pivot shafts extend through two slots of a support frame which includes two racks on two insides thereof so that when the printing member is lowered when pressing the casing downward, the teeth movably engage with the racks and the printing member rotates 180 degrees so that the printing face faces downward to stamp on document.

4 Claims, 5 Drawing Sheets

STAMPING DEVICE HAVING A REVERSIBLE PRINTING MEMBER

FIELD OF THE INVENTION

The present invention relates to a stamping device having a reversible printing member which turns 180 degrees during moving downward.

BACKGROUND OF THE INVENTION

A conventional stamping device 50 is disclosed in FIGS. 5A, 5B and 5C, and generally includes a casing 51 and a frame 54 which has one end inserted in the opening of the casing 51 with a spring 55 connected between the inner top of the casing 51 and the outer top of the frame 54. Two slots 541 are defined through two opposite walls of the frame 54 and a printing member 53 is movably received in the frame 54. A pin 52 extends through the printing member 53 and two ends of the pin 52 are movably engaged with the two slots 541. An upper protrusion 542 and a lower protrusion 544 are defined in a side of the each of the slots 541. A turning recess 543 is located between the upper and lower protrusions 542, 544. The printing member 53 has two convex 531 on two sides thereof and the printing member 53 starts to turn when the convex 531 contacts the upper protrusion as shown in FIG. 5B. As shown in FIG. 5C, the convex 531 then rotates 180 degrees in the turning recess 543 and the printing face 532 on the printing member 53 faces downward to stamp on document which is not shown. When releasing the downward force on the casing 51, the frame 54 is pushed away from the casing 51 and the printing member 53 inversely rotates and the pin 52 moves upward relative to the slots 541. Nevertheless, it is difficult to assemble the stamping device and the convex 531; the upper protrusion 542 and the lower protrusion 544 are easily worn out which results in mis-function or mis-movement of the printing member 53.

The present invention intends to provide a stamping device wherein the printing member is rotated by the engagement of the racks on the frame and the teeth on the printing member.

SUMMARY OF THE INVENTION

The present invention relates to a stamping device that comprises a casing and a frame having an ink pad is inserted in an open bottom of the casing. A spring is biased between the inner top of the casing and an outer top of the frame. A support member has an end plate with an aperture defined therethrough and two connection bars extend perpendicularly from each one of two ends of the support member. A slot is defined between the two connection bars which are connected to the frame. A rack is attached on an inside of one of the two connection bars of each end of the support member. A printing member has a printing face on one side thereof and two pivot shafts extend from two opposite ends thereof. The two pivot shafts movably extend through the two slots of the support frame and are pivotably connected to the two insides of the casing. A plurality of teeth are arranged on a semi-circular protrusion on the two opposite ends of the printing member so that the teeth are movably engaged with the racks and the printing member rotates 180 degrees.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
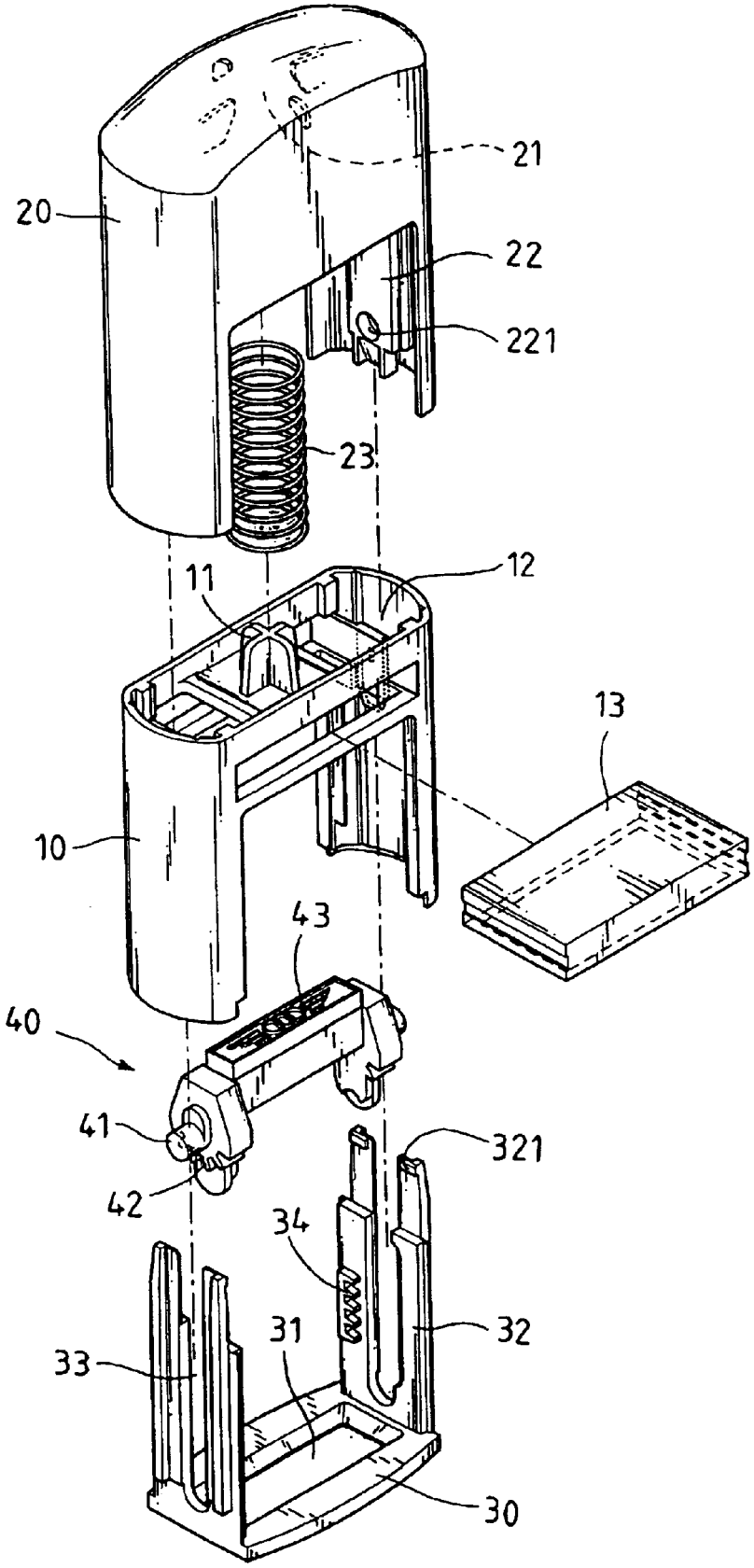
FIG. 1 is an exploded view to show the stamping device of the present invention.
Figure 2:
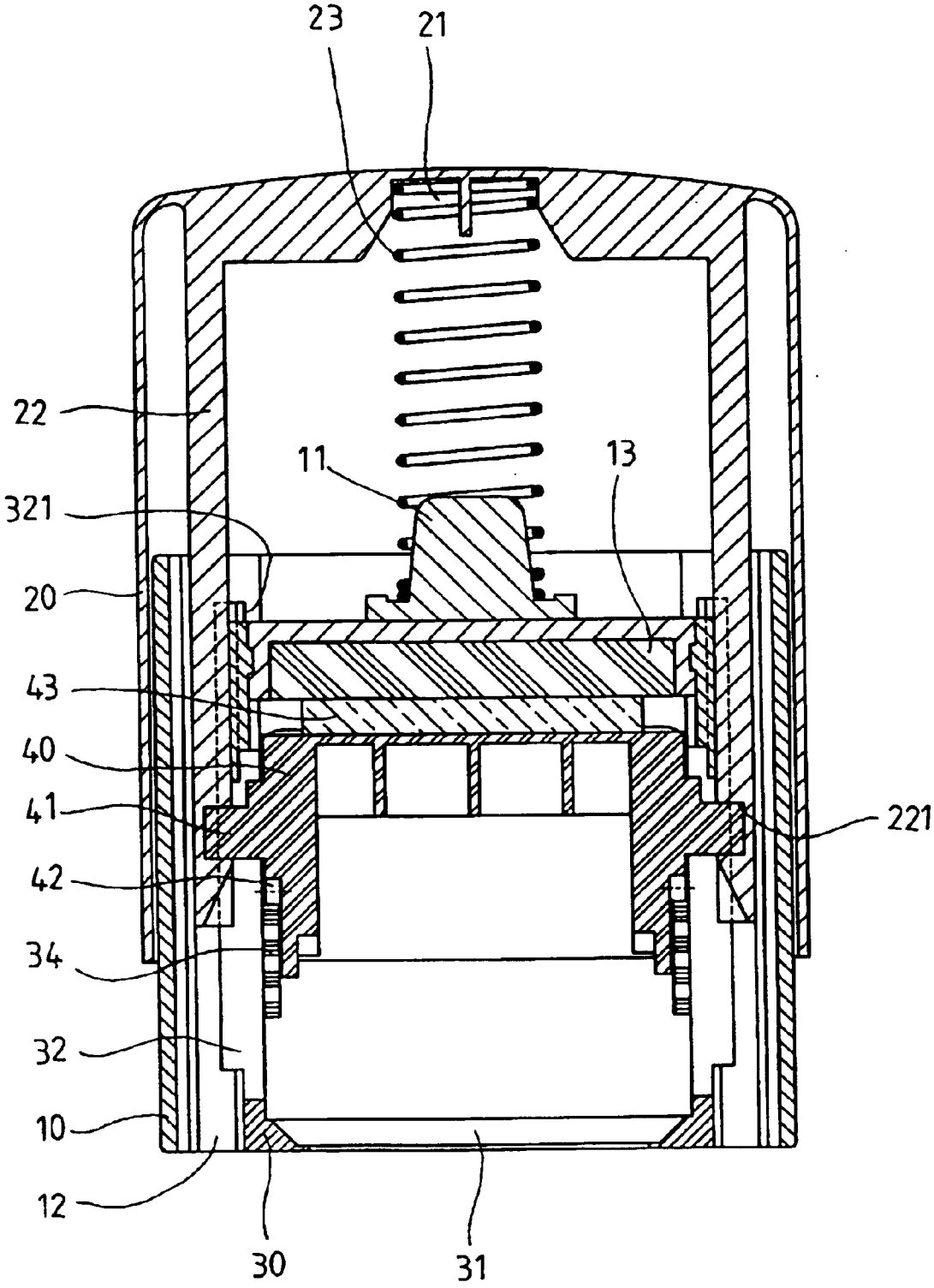
FIG. 2 is a cross sectional view to show the stamping device of the present invention when the casing is not yet pushed.
Figure 3:
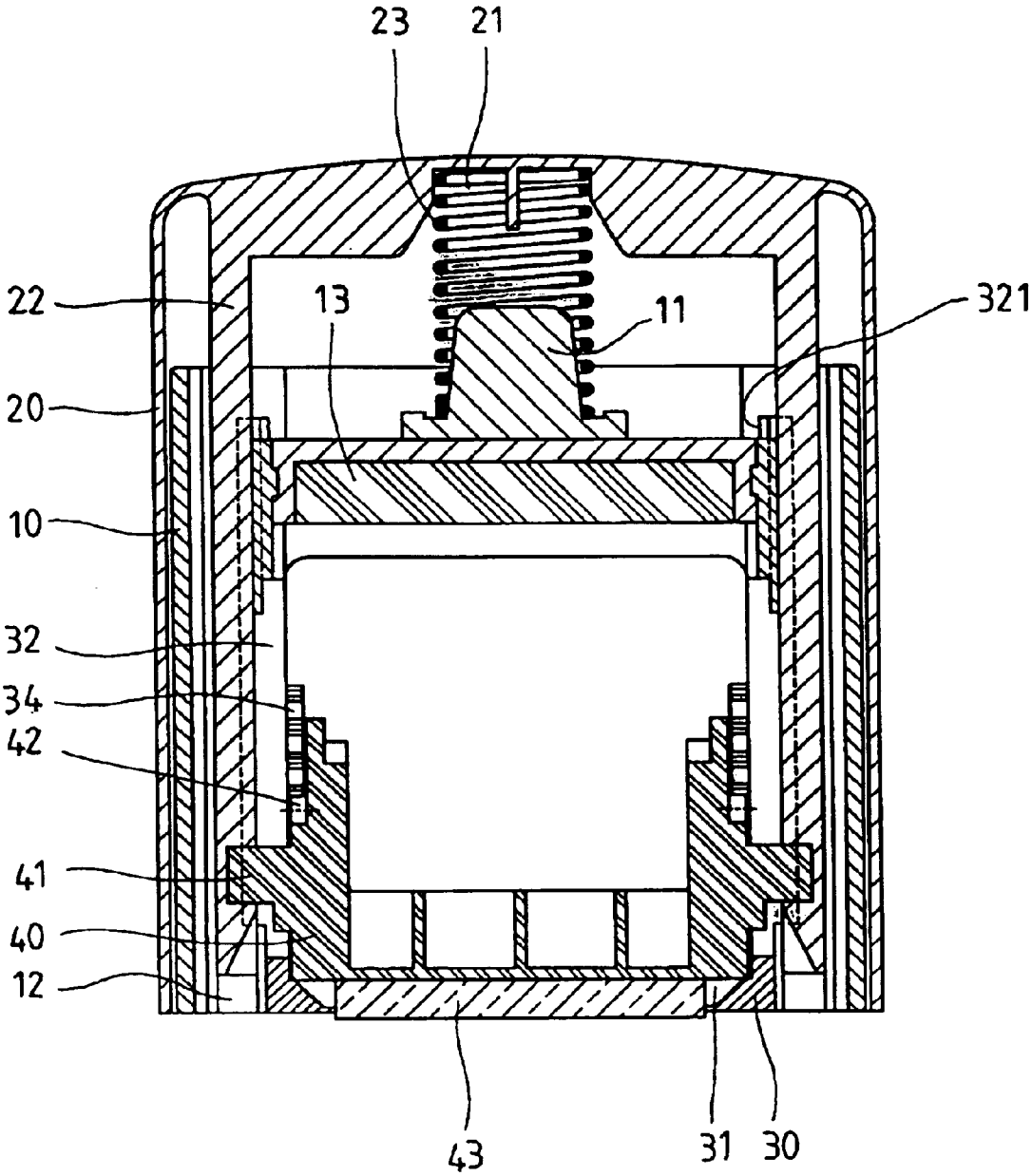
FIG. 3 is a cross sectional view to show the stamping device of the present invention when the casing is pushed.
Figure 4C:
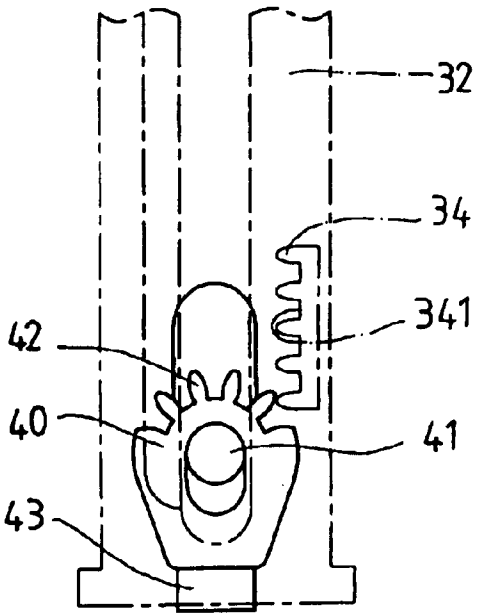
FIGS. 4A, 4B and 4C show how the printing member rotates 180 degrees during stamping.
Figure 4B:
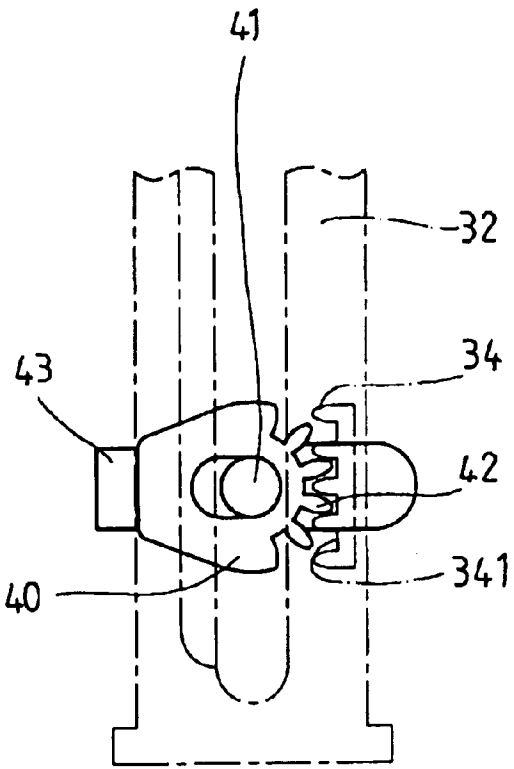
Figure 4A:
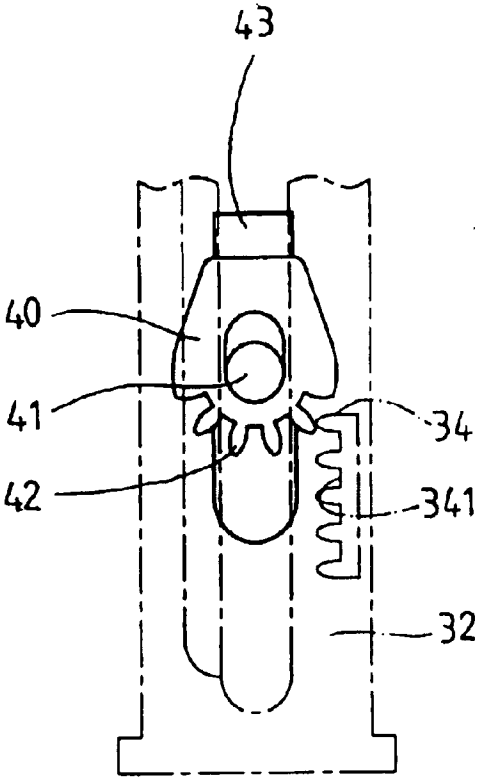
Figure 5A:
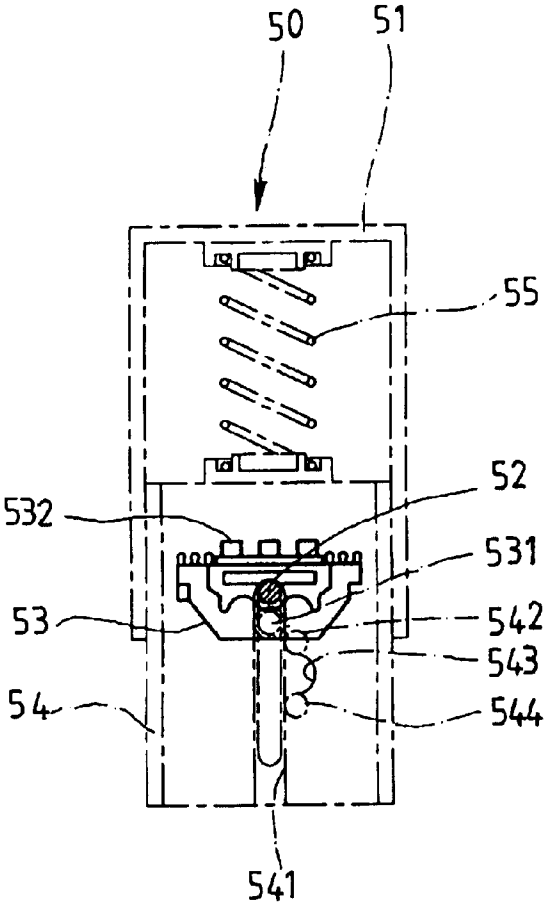
FIG.5A PRIOR ART
FIGS. 5A, 5B and 5C show how the conventional printing member rotates 180 degrees during stamping.
Figure 5B:
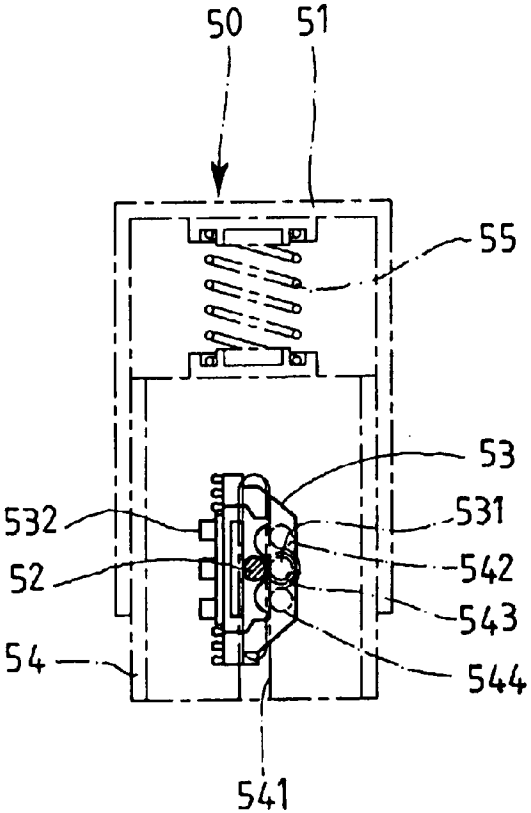
FIG.5B PRIOR ART
Figure 5C:
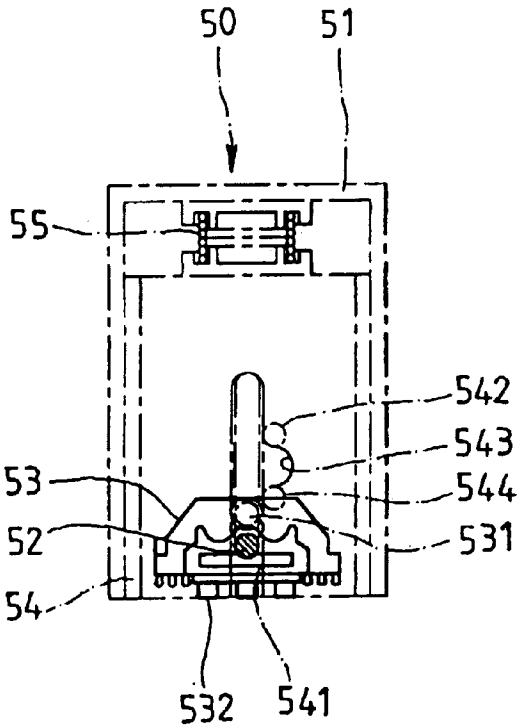
FIG.5C PRIOR ART

Referring to FIGS. 1 and 2, the stamping device of the present invention comprises a casing 20 having a top and two insides. Two guide rods 22 extend from an inner top of the casing 20 and each of the two guide rods 22 has a recess 221 defined in a surface thereof. A plurality of ridges extends from the inner top of the casing 20 so as to form a fitting space 21 between the ridges.

A frame 10 has an end inserted in an open bottom of the casing 20 and an ink pad 13 is inserted transversely in the frame 10. The end that is inserted in the casing 20 includes an outer top that includes two holes 12 on two ends thereof such that the two guide rods 22 are movably inserted in the two holes 12. A positioning protrusion 11 extends from the outer top of the frame 10. A spring 23 has one end fitted in the fitting space 21 and the other end of the spring 23 is mounted on the positioning protrusion 11.

A support member 30 has an end plate with an aperture 31 defined therethrough and two connection bars 32 extend perpendicularly from each one of two ends of the support member 30. A slot 33 is defined between the two connection bars 32 and each connection bar 32 includes a hooking part 321 on an outside of a top thereof, the hooking parts 321 are connected to the frame 10. A rack 34 is attached on an inside of one of the two connection bars 32 of each end of the support member 30.

A printing member 40 has a printing face 43 on one side thereof and two pivot shafts 41 extend from two opposite ends thereof. The two pivot shafts 41 movably extend through the two slots 33 of the support frame 30 and pivotably engaged with the recesses 221 in the guide rods 22 of the casing 20. A plurality of teeth 42 are arranged on a semi-circular protrusion on the two opposite ends of the printing member 40.

When stamping, referring to FIGS. 3, 4A, 4B and 4C, a user presses the casing 20 downward and the casing 20 moves downward and the spring 23 is compressed. The guide bars 22 bring the printing member 40 downward along the slots 33 of the support frame 30. When the teeth 42 are engaged with the racks 34, the printing member 40 rotates till the printing member 40 rotates 180 degrees. The printing face 43 is then accessible via the aperture 31 of the support frame 30 and stamps on document. When releasing the force applied to the casing 20, the spring 23 pushes the casing 20 upward and away from the frame 10, the printing member 40 is brought upward with the casing 20 and the printing member 40 is rotated in an opposite direction and back to the position as shown in FIG. 2.

While we have shown and described the embodiment in accordance with the present invention, it should be clear to those skilled in the art that further embodiments may be made without departing from the scope of the present invention.

What is claimed is:

1. A stamping device comprising:

a casing having two insides;

a frame having an end inserted in an open bottom of the casing and an ink pad connected in the frame, a spring biased between the inner top of the casing and an outer top of the frame;

a support member having an end plate with an aperture defined therethrough and two connection bars extending perpendicularly from each one of two ends of the support member, a slot defined between the two connection bars which are connected to the frame, a rack attached on an inside of one of the two connection bars of each end of the support member, and a printing member having a printing face on one side thereof and two pivot shafts extending from two opposite ends thereof, the two pivot shafts movably extending through the two slots of the support frame and pivotably connected to the two insides of the casing, a plurality of teeth arranged on a semi-circular protrusion on the two opposite ends of the printing member so that the teeth are movably engaged with the racks and the printing member rotates 180 degrees.

2. The stamping device as claimed in claim 1, wherein the casing includes two guide rods extending from an inner top thereof and the outer top of the frame includes two holes on two ends thereof such that the two guide rods are movably inserted in the two holes.

3. The stamping device as claimed in claim 2, wherein each of the two guide rods has a recess defined in a surface thereof and the two pivot shafts of the printing member are engaged with the two recesses.

4. The stamping device as claimed in claim 2, wherein a plurality of ridges extend from the inner top of the casing so as to form a fitting space between the ridges, the outer top of the frame having a positioning protrusion, the spring having one end fitted in the fitting space and the other end of the spring mounted on the positioning protrusion.

* * * * *